United States Patent [19]

Taylor

[11] Patent Number: 4,645,150

[45] Date of Patent: Feb. 24, 1987

[54] PUSH-IN WALL MOUNT FOR VACUUM CLEANING SYSTEM

[75] Inventor: F. Warren Taylor, Cary, N.C.

[73] Assignee: Fasco Industries, Inc., Boca Raton, Fla.

[21] Appl. No.: 814,363

[22] Filed: Dec. 30, 1985

[51] Int. Cl.[4] ..... F16L 5/00

[52] U.S. Cl. ..... 248/56; 15/314

[58] Field of Search ..... 248/27.1, 27.3, 56, 248/DIG. 6; 15/314, 315; 52/221, 126.1, 126.3, 126.5; 285/158, 133, 413, 205, 206, 64; 137/360, 361, 362

[56] References Cited

U.S. PATENT DOCUMENTS

| | | | |
|---|---|---|---|
| 1,689,575 | 10/1928 | Winn | 285/205 X |
| 1,809,250 | 6/1931 | Pendleton | 285/206 |
| 2,518,426 | 8/1950 | Kinander | 285/206 |
| 2,990,562 | 7/1961 | Bishop | 15/314 X |
| 3,036,814 | 5/1962 | Stevens | 137/360 X |
| 3,076,068 | 1/1963 | Racklyeft | 15/314 X |
| 3,180,595 | 4/1965 | Brunsting et al. | 248/27.3 |
| 3,319,909 | 5/1967 | Goslin | 248/27.3 |
| 3,483,503 | 12/1969 | Paradiso | 15/314 X |
| 3,842,709 | 10/1974 | Fuqua | 248/27.3 X |
| 4,336,427 | 6/1982 | Lindsay | 137/360 X |

*Primary Examiner*—J. Franklin Foss

*Attorney, Agent, or Firm*—Shlesinger, Fitzsimmons & Shlesinger

[57] ABSTRACT

An inlet wall mounted valve device for a central vacuum system is disclosed as having back and front plates arranged on either side of a wall to which the valve device is to be mounted. The back plate, composed of flexible metallic material, is adapted to be compressed and pushed through an opening in the wall having a smaller dimension than the width of the back plate so that the back plate will assume its normal relaxed condition behind the wall and extend beyond side edges of the opening. Fastening devices, such as screws, connecting the front plate to the back plate serve to draw each plate toward the other and thereby attach the valve device to the wall.

5 Claims, 4 Drawing Figures

PUSH-IN WALL MOUNT FOR VACUUM CLEANING SYSTEM

BACKGROUND OF THE INVENTION

The present invention relates generally to apparatus devised for general cleaning purposes, and more particularly, to a wall-mounted inlet valve assembly for a central vacuum cleaning system.

In the conventional central vacuum cleaning systems, a number of inlet valves are mounted in the walls of a building or house and are interiorly connected within the wall structure to a central vacuum producing system. Each room of the building or house is adapted to be cleaned by a standard vacuum cleaner by insertion of a suitable coupling at one end of a flexible hose for the cleaner into the inlet valve, and by activating the vacuum system control for effecting operation of the vacuum producing means. The flexible hose and vacuum cleaner assembly may be carried or moved from room to room and be connected to other wall inlet valves for further vacuum cleaning.

One of the problems in the installation of a central vacuum system of the type which is provided with one or more inlet wall valves for one or more of the rooms of a building or house is in the particular installation devices utilized with the wall mount for the inlet valve. Generally wall mounts are equipped with a back mounting plate designed to be turned and pushed through an opening cut into a wall and to which a front plate for the inlet valve is mounted by suitable fasteners. Since the installer is not able to position his hand on the back side of a wall, it is difficult for him to hold the back plate while the front plate is attached thereto. These installations can be time consuming and very aggravating because of frustrations resulting from many attempts to hold the back plate in place while trying to apply fasteners such as screws and the like to hold the front plate to the back plate.

Prior art attempts to solve this problem usually require high cost fasteners and time consuming manipulations which result in high cost installation labor charges. In U.S. Pat. No. 3,291,927, an inlet valve assembly is disclosed which utilizes "toggle" bolts used in conjunction with added drilled holes formed in the wall. A self-securing fastening device is disclosed in U.S. Pat. No. 4,496,790 which utilizes a pair of spring members 54 adapted to be pushed through an opening for a wiring outlet device. These spring members are particularly shaped for engaging and locking in the side walls of an opening formed in a concrete floor which is to support the electrical outlet. These spring members have no structural arrangement adapted to reach the back of a wall for supporting the wiring receptacle. In U.S. Pat. No. 3,076,068, a vacuum cleaning wall mount receptacle is disclosed which utilizes a backplate requiring extra drilling and location of drill holes for the insertion of mounting screws.

SUMMARY OF THE INVENTION

In the present invention, the problem specified above is readily solved by an arrangement requiring very simple and economical parts. These parts may be mounted very quickly and in a single operation by which even the most inexperienced mechanic may succeed. The present invention utilizes a back plate formed on light spring material having angularly bent side portions which are adapted to be squeezed by the hand of the operator. After the portions are squeezed to assume a size smaller than the opening, the back plate is pushed through the previously formed opening in the wall which is to serve as the supporting mount for the inlet valve apparatus. Before this pushing-in of the back plate, the front plate for the inlet valve assembly is lightly affixed thereto by two opposing screws so that the front plate and the back plate may be moved and applied to the wall as a unit. The angled portions of the back plate, when extended or relaxed, are larger than one dimension of the opening formed in the wall so that, upon release of these portions after they have been pushed in through the opening, they will expand to assume their normal relaxed positions.

These normal positions of the angled portions will extend beyond side edges of the opening and thereby serve as an easily mounted back plate for the valve assembly. Upon tightening of the two screws, the back plate will become securely fastened to the rear surface of the mounting wall adjacent the side edges of the opening therein. The cover plate for the inlet valve assembly may then be easily applied to the front plate which serves as the mounting support structure for the remaining parts of the inlet valve assembly.

Therefore it is the principal object of the present invention to permit the installation of an inlet vacuum valve assembly in a minimum of time and with a minimum of parts.

It is a further object of the present invention to permit the installation of an inlet vacuum valve assembly by requiring a minimum of steps and labor consuming activity and thereby lessen the cost of installing inlet valve assemblies.

These and other objects of the present invention will become apparent after reading the following specifications taken in conjunction with the accompanying drawings.

THE DRAWINGS

DETAILED DESCRIPTION OF THE PREFERRED EMBODIMENT

Figure 1:
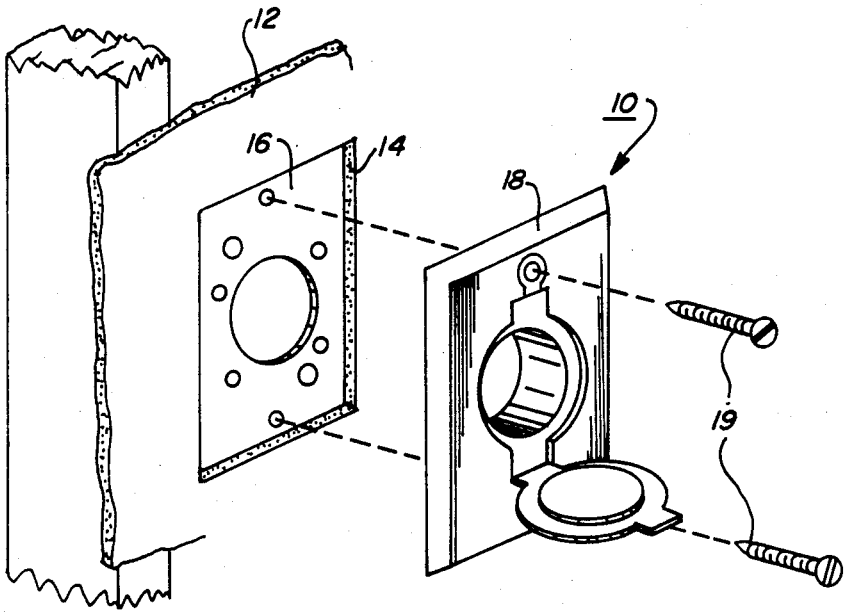
FIG. 1 is an exploded perspective view of an inlet valve assembly presently on the market mounted upon a structural wall.

In FIG. 1, parts of a conventional inlet valve assembly indicated generally by the reference numberal 10 are positioned adjacent a structural wall 12 of a building to which the valve assembly is to be mounted. An opening 14 of rectangular shape has been formed in the wall by a previous operation of the installer in order to permit the insertion of a back plate 16 for the inlet valve assembly. In mounting the back plate 16 to the back side of the wall 12, the installer turns the back plate 90 degrees from the position shown and inserts the same through the opening 14 by hand. Then, by trial and error, the installer attempts to hold the plate thereat while a cover plate 18 is aligned therewith so that mounting screws 19 may be applied through suitable holes formed in the cover plate and the back plate.

The problem with the mounting of the inlet valve assembly shown in FIG. 1 is the need to hold the back plate 16 while the cover plate 18 and screws 19 are applied thereto. Various items are generally utilized in holding the back plate during mounting operations, such as by use of wires, string and fingers, until the screws 19 from the cover plate can be started into the back plate. In attempting to hold the back plate, it often times becomes misaligned, thereby needing repeated attempts to realign, or falls back between the partitions of the wall thus necessitating further attempts with another back plate. Several attempts may be made to accomplish the mounting of the back plate thus requiring additional labor charges, and perhaps worse, aggravation for the installer.

Figure 2:
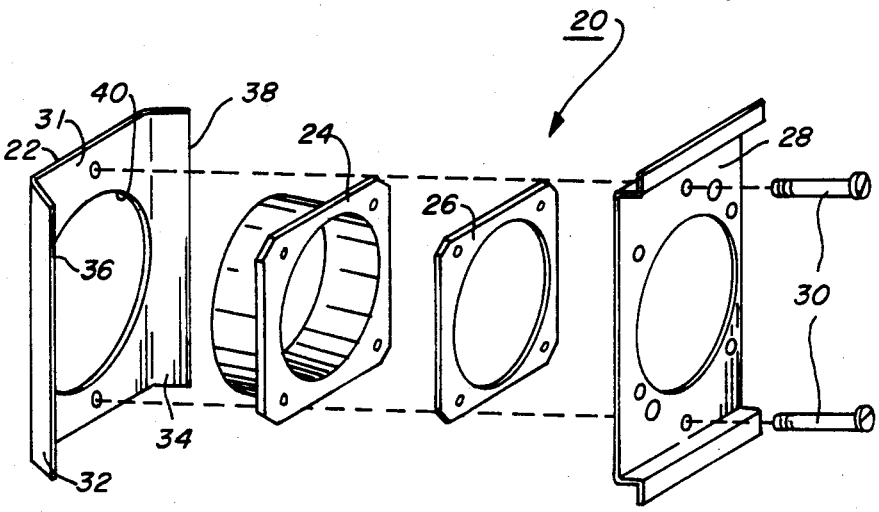
FIG. 2 is an exploded perspective view of the inlet valve assembly of the present invention.

In the present invention as illustrated in FIG. 2, an inlet valve assembly indicated generally by the reference numeral 20 comprises an improved back plate 22, a cylindrical coupling member or fitting 24, a gasket 26, a front plate 28 and screws 30. The back plate 22 comprises a singular metallic member made of light metallic spring material having a planar structural portion 31 and angularly bent side portions 32, 34 positioned along the longitudinal edges of the member. As shown in FIG. 2, the member 22 is in its normal or relaxed condition wherein the outer edges 36, 38 of the back plate extend further in a transverse direction than the width of the opening 14 in a wall to which the inlet valve assembly is to be mounted. A suitable opening 40 is formed in the central portion of the member 22 accomodating the coupling or fitting 24 in the conventional manner. The plates 22 and 28 when mounted on a wall are spaced from each other with the coupling 24 therebetween to support the same.

Figure 3:
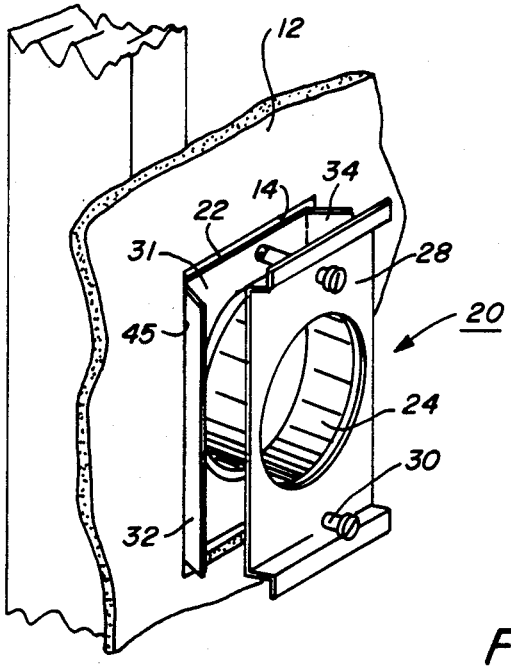
FIG. 3 is a perspective view of the present invention as applied to the front side of a wall mounting the same.

As shown in FIG. 3, the present invention is illustrated being applied to the structural wall 12 of the building to which the inlet valve assemblies are to be mounted. While the present invention is illustrated and described in relation to a structural wall for a building, it will be understood that the present invention may be applied to the floor or ceiling of the building. All of the structural elements of the assembly 20, namely back plate 22, the fitting 24, the gasket 26 and the front plate 28 are loosely retained by the screws 30 in approximately the positions as shown. The loosely assembled parts are held by the hand of the installer who pushes the back plate 22 through the opening 14 formed in the wall. The pushing-in of the back plate is preferably accomplished by manually gripping the screws 30 and pushing the parts of the inlet valve as a unit.

Figure 4:
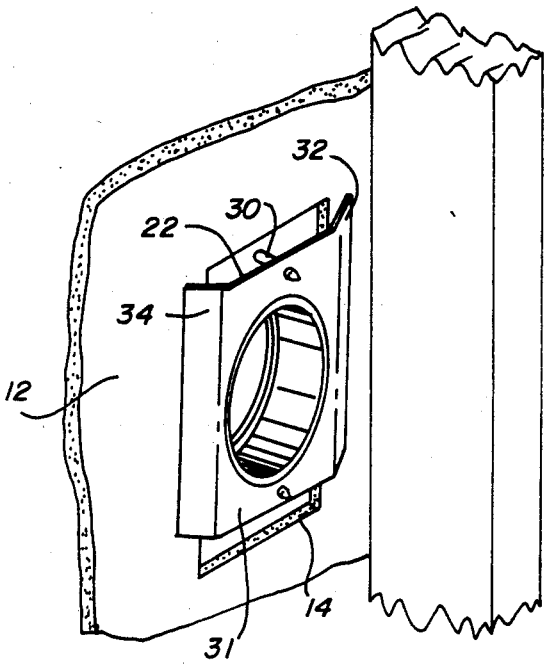
FIG. 4 is a perspective view of the present invention as applied to the back side of the wall.

As the back plate 22 is being pushed through the opening, the angular side portions 32, 34 are squeezed upon engagement of the side edges 45 of the opening 14 thereby compressing somewhat the back plate until the edges 36, 38 of the angularly bent portions 32, 34, respectively, are driven past the edges 45. In order to accommodate the pushing-in of the plate 22 through the opening, the vertical length thereof is slightly larger than the vertical dimension of the plate 22. In the alternative, or as an assist, the portions 32, 34 may be squeezed by the installer as the back plate is pushed through the opening 14. Upon this occurrence, the back plate, in assuming its normal relaxed condition, results in the springing back of the members 32, 34, as shown in FIG. 4. With the back plate 22 now being in its relaxed condition, the edges 36 and 38 for the portions 32, 34, respectively, extend outwardly to engage the back side of the wall 12 a sufficient distance away from the vertical longitudinal edges 45 of the opening 14 thus enabling the plate 22 to be securely held against the wall. The two screws 30, which are located at the center of the portion 31, are then tightened to bring the back plate 22 and the front plate 28 securely against the corresponding surfaces of the wall 12 thus conditioning the front plate 28 to receive the cover plate 18.

With the side portions 32, 34 being angled relative to the plan or portion 31 of the back plate 22, a strengthened structural element is formed similar to "angle iron." The angled relationship provides a fairly high degree of strength to the back plate, especially when the screws 30 are tightened. The more these centrally located screws are tightened, the more the angular relationship increases which, in turn, increases the strength of the back plate for its mounting purposes.

Coupling devices associated with the central vacuum system that would connect the inlet valve assembly 20 to a central vacuum system and to a flexible hose of a vacuum cleaner within the room have been purposely left out since they do not enter into the inventive concept herein. Similarly, electrical contacts, sockets or the like for connecting a vacuum cleaner to a source of electrical power have been purposely omitted as these items do not form a part of the present invention.

From the foregoing it will be apparent that the present invention provides an arrangement for attaching an inlet vacuum valve assembly to a wall requiring a minimum of manipulative steps and a minimum of parts, which parts may be applied to the wall without trial and error manipulations.

While this invention has been illustrated and described in detail in connection with a particular embodiment, it will be understood that other embodiments may be devised for which the concept of the invention can be applied and that any modifications are intended to be covered as well being in the scope of one skill of the art or the appended claims.

I claim:

1. An inlet valve assembly for a central vacuum system adapted to be mounted on a wall or other structural support for a building to provide vacuum flow from one side of the wall to the other side thereof through an opening formed in the wall or other structural support, comprising an annular coupling member adapted to be received in said opening for connection to a source of vacuum, first and second plate members each having therethrough a central aperture, and means adjustably connecting said members in spaced relation to each other with said coupling member extending therebetween coaxially of said central apertures in said members, one of said plate members being formed from flexible material, and being of a size such that when it registers with said opening and is in its relaxed, normal condition, opposed portions thereof extend beyond opposed edges of said opening, said one plate member being adapted, during the mounting of the assembly on said wall or support to be flexed to a size wherein the same may be pushed through said opposed edges of said opening thereafter to assume its relaxed condition after being pushed therethrough, and said connecting means being adjustable after the mounting of the assembly on said wall or support to draw said plate members toward each other with said opposed portions of said one plate member urged against one side of the wall or other structural support, and with the other of said plate members urged against the other side of the wall or other structural support.

2. The inlet valve assembly in claim 1 wherein said opposed portions of said one plate member includes angled portions arranged to engage the back side of the wall when said one plate member is pushed through the opening.

3. The inlet valve assembly of claim 1 wherein said connecting means is adapted to cause said angled portions of said one plate member to approach a common plane as the same are urged against said one side of the wall.

4. An inlet valve assembly for a central vacuum system adapted to be mounted on a wall or other structural support for a building and having a coupling arranged to provide vacuum flow from one side of the wall to the other side thereof through an opening formed in the wall or other structural support, comprising a first member arranged to receive the coupling, a second member cooperable with said first member arranged for supporting the coupling on the wall or other structural support, said first member being formed generally planar from flexible material and being of a size, when in its relaxed, normal condition, such that opposed portions thereof are disposed to extend beyond opposed edges of said opening, said first member being adapted to be flexed to a size wherein the same may be pushed through said opposed edges of said opening and to assume its relaxed condition after being pushed therethrough, and means for adjustably connecting said members in spaced relation to each other with said coupling extending therebetween, whereby said assembly may be manipulated manually to push said first member through said opening until said opposed portions overlie one side of the wall or other structural support and said second member overlies the other side of the wall or other structural support, said means thereafter being adjustable to draw said members together against opposite sides of said wall or support.

5. The inlet valve assembly in claim 4 wherein said first member includes angled portions arranged to engage side of the wall when said one member is pushed through the opening.

* * * * *